US009996054B2

(12) United States Patent
Heise

(10) Patent No.: US 9,996,054 B2
(45) Date of Patent: Jun. 12, 2018

(54) MECHANICAL CLOCKWORK MOVEMENT WITH A TOURBILLON

(71) Applicant: Glashuetter Uhrenbetrieb GmbH, Glashuette/Sachsen (DE)

(72) Inventor: Joern Heise, Rudolstadt (DE)

(73) Assignee: Glashuetter Uhrenbetrieb GmbH, Glashuette/Sachsen (DE)

( * ) Notice: Subject to any disclaimer, the term of this patent is extended or adjusted under 35 U.S.C. 154(b) by 62 days.

(21) Appl. No.: 15/206,661

(22) Filed: Jul. 11, 2016

(65) Prior Publication Data

US 2017/0060091 A1 Mar. 2, 2017

(30) Foreign Application Priority Data

Aug. 31, 2015 (EP) ..... 15183133

(51) Int. Cl.

*G04B 17/28* (2006.01)
*G04B 27/00* (2006.01)
*G04B 27/02* (2006.01)

(52) U.S. Cl.

CPC ..... *G04B 17/285* (2013.01); *G04B 27/004* (2013.01); *G04B 27/005* (2013.01); *G04B 27/026* (2013.01)

(58) Field of Classification Search

CPC .. G04B 17/285; G04B 27/004; G04B 27/005; G04B 27/026

See application file for complete search history.

(56) References Cited

U.S. PATENT DOCUMENTS

| | | | | |
|---|---|---|---|---|
| 7,244,062 | B2 * | 7/2007 | Golay | G04B 17/285 368/127 |
| 9,052,692 | B2 * | 6/2015 | Capt | G04B 17/28 |
| 9,058,020 | B2 * | 6/2015 | Rochat | G04B 17/28 |
| 2004/0062149 | A1 | 4/2004 | Geyer | |
| 2007/0230286 | A1 | 10/2007 | Scheufele | |
| 2014/0313865 | A1 | 10/2014 | Heise | |

FOREIGN PATENT DOCUMENTS

| | | | |
|---|---|---|---|
| DE | 101 60 287 | A1 | 6/2003 |
| DE | 10 2006 008 699 | B3 | 8/2007 |
| EP | 1 840 677 | A1 | 10/2007 |
| EP | 2 793 087 | A1 | 10/2014 |

OTHER PUBLICATIONS

European Search Report dated Mar. 14, 2016 in European Application 15183133, filed on Aug. 31, 2015 ( with English Translation of Categories of cited documents).

* cited by examiner

*Primary Examiner* — Edwin A. Leon
*Assistant Examiner* — Jason Collins
(74) *Attorney, Agent, or Firm* — Oblon, McClelland, Maier & Neustadt, L.L.P.

(57) ABSTRACT

A timepiece with a tourbillon unit, including a base plate, cage placed rotatably on the base plate and being connected to a fourth pinion, a balance placed on the cage, and an escape wheel that is placed on the cage and that is in work connection with the balance, a balance stop device being capable to be brought into engagement with the balance, wherein it further includes a zero-setting device for the angular orientation of the cage.

15 Claims, 9 Drawing Sheets

MECHANICAL CLOCKWORK MOVEMENT WITH A TOURBILLON

This application claims priority from European Patent Application No 15183133.6 filed Aug. 31, 2015, the entire disclosure of which is hereby incorporated herein by reference.

TECHNICAL AREA

The present invention relates to a mechanical clockwork movement with a tourbillon and so to a mechanical watch fitted with such.

BACKGROUND

Tourbillons for mechanical clocks and clockwork movements are well-known. Here, the escape wheel, the pallets and the so-called balance of the clockwork movement are carried by a mobile cage which is coupled to or has a fixed connection with the shaft of the fourth wheel, and thus to the fourth pinion. The balance or staff coincides here typically with an imaginary axis extension of the fourth pinion. A toothed wheel connected to the escape wheel finally meshes with a fixed toothed wheel coaxial with the staff so that the tourbillon, thus its cage, makes one complete revolution per minute.

For an exact setting of a mechanical watch, it is necessary to stop the indication of seconds. With conventional clockwork movements, this is made mostly by a so-called balance stop, which for example is activated by pulling out the crown and can be deactivated by pushing back the crown wheel.

Watches with a minute-tourbillon, having an indication of seconds being made by the mobile cage of the tourbillon, the implementation of such a balance stop turns out to be extremely difficult and complicated.

A balance stop for a tourbillon is well-known, for example from EP 2 793 087 A1. It is performed by a braking-element which can be brought into engagement with the staff and is movable coaxial with the latter. To match the watch with a standard time, it is therefore possible to stop the balance, and thus the tourbillon mechanism at any time.

SUMMARY OF THE INVENTION

By contrast it is as object of the present invention to provide an improved balance stop for a tourbillon of a mechanical watch. In addition to a stopping of the tourbillon, a zero-setting of the tourbillon for easy time setting is to be realized. This is to improve the operability and time setting of the watch and also give the watch an increased functional scope.

This object is solved by a clockwork movement having a tourbillon unit according to the independent patent claim 1 and by a watch having such a clockwork movement according to patent claim 15. Advantageous embodiments in this respect are subject of the dependent patent claims.

In this respect a clockwork movement of a mechanical watch is provided with a tourbillon unit. The clockwork movement has a base plate which carries all moving components of the clockwork movement. The clockwork movement, especially its tourbillon unit, further comprises a cage connected to a fourth pinion being rotatable mounted on the base plate and a balance mounted on the cage. An escape wheel which is in work connection with the balance is also mounted on the cage in addition to the balance. The escape wheel is typically in work connection with the balance via pallets. Balance, pallets and escape wheel herewith build the escapement of the mechanical clockwork movement. The fourth pinion is typically coupled with an energy store, for example a barrel, which finally drives the clockwork movement.

The clockwork movement is further provided with a balance stop device that can engage the balance. By means of the balance stop device, the balance can be at least temporarily fixed relative to the base plate or relative to the cage to stop the clockwork movement. Furthermore, the clockwork movement is provided with a zero-setting device that allows the angular orientation of the cage to be set in a predetermined position that preferably corresponds to the zero position of a seconds hand attached to the cage. According to a preferred embodiment, the zero-setting device can be optionally torque-proof engaged with the cage or with the base plate. The zero-setting device is typically torque-proof connected to the base plate of the watch in normal operation.

This means that the zero-setting device is fixed relative to, or directly on, the base plate whereas the cage, together with the entire tourbillon unit, is exposed to a rotational movement relative to the base plate. When the clock movement is stopped, especially for setting the time, the zero-setting device is also detachable from the base plate or can be pivotally decoupled so that it can be pivotated relative to the base plate. It typically engages to the cage in a torque-proof manner. The zero-setting device therefore always either engages the cage in a torque-proof manner or the base plate or the zero-setting device even engages both the cage and the base plate in a torque-proof manner.

It is possible to decouple the cage for setting the time at least temporarily from the energy storage device of the clockwork movement by using the option of torque-free engaging the zero-setting device with the base plate or the cage. Using an alternating fixing or torque-proof connection to the zero-setting device with the cage or base plate, it is possible for the zero-setting device, together with the cage, to create a zero-stop function, also for example under the influence of the mechanical energy storage of the movement but decoupled from the minutes or hours pinion of the clockwork movement, is transferable to a defined zero-setting.

The optional engagement of the zero-setting device with the cage or with the base plate can be achieved by successive and stepwise pulling-out of a crown, for example a winding or setting crown of the clockwork movement. According to a preferred embodiment of the claimed clockwork movement, the crown can be in three different axial positions, i.e. is a first so-called rest position in which for example the mainspring can be wound up as usual by the crown, in a second position at which the balance is stopped, e.g. according to the solution of EP2793087 and in a third axial position where the zero-setting device is no longer engaged with the base plate, but with the cage. Then, at this third position of the crown, the zero-setting device and the cage as a complete unit can be pivoted by the clockwork via the seconds pinion, and thus the zero setting of the cage takes place automatically, wherein the minutes hand setting can be provided by turning the crown at this position. Preferably, a minutes ratcheting may further be present incl. hands friction in a minute wheel group similar to that in Patent EP2224294; the tourbillon unit and the zero-setting device according to the preset invention are compatible with that—thanks to permanent engagement between the minute wheel, third wheel and second pinion.

According to a further design, it is provided that the zero-setting device is torque-proof fixed to the base plate in a basic configuration. In the basic configuration, the crown is in a basic position in which the clockwork movement is driven by a mechanical energy store. The zero-setting device acts as a type of base for the tourbillon unit by its fixing to the base plate. Particular provision can be made that the tourbillon unit, or a part thereof, is in work connection with the zero-setting device. In the basic configuration at a zero-setting device fixed to the base plate, this acts solely as a support for further mechanical components of the clockwork movement, for the tourbillon unit or individual components thereof for example.

According to a further embodiment, the zero-setting device is torque-proof coupled to the cage by means of the balance that has been stopped by the balance stop device. In the basic configuration, the cage can pivote freely relative to the base plate. This means, that the cage only pivotes relative to the base plate under influence of the escapement and under influence of the mechanical driving energy from the barrel. As soon as the cage is stopped by the balance stop device and fixed relative to the base plate, the zero-setting device can be either indirectly or directly coupled to the cage in a torque-proof manner.

It is conceivable that zero-setting device and balance stop device have such a mutual interaction that the zero-setting device is torque-proof coupled to the cage by activating the balance stop device. It is also conceivable that the zero-setting device already has a fixed connection with the balance stop device. Fixing of the cage relative to the base plate by means of the balance stop device leads in this respect also inevitably to a torque-proof fixing of the cage relative to the zero-setting device.

By a direct or indirect coupling between zero-setting device and cage, it is possible for example to torque-proof connect the zero-setting device to the cage for the purpose of adjusting the clockwork movement. By means of the zero-setting device, the cage fixed to it can be returned to a defined zero position from any position in which the cage has been stopped, the zero position being such that a seconds hand on the cage points to the zero.

According to a further embodiment, the balance stop device comprises a braking element located axial movable to a balance axis on the rotating cage and frictionally engaged with the balance. A balance stop can be realized using such a braking element which does not exert any radially asymmetric forces on the balance or on the rotating cage of the tourbillon. The balance can also be braked immediately via such a braking element, especially stopped. A braking and stopping of the balance also leads inevitably to a stop of the rotational movement of the tourbillon, i.e. the rotational movement of the rotating cage is stopped.

Because of the axial mobility of the braking element, this can for example be engaged for braking with an axially directed end face of the balance or with a section fixed to the balance, for example a double roller torque-proof connected to the balance. The balance can therefore be directly or indirectly braked and stopped so that post-oscillations of the balance when activating the balance stop are not to be feared. The balance stop device is especially suitable for implementing a balance stop for a flying tourbillon as the balance stop device only affects the balance in the axial direction.

Due to the frictional interaction between braking element and balance, it is also possible to increase the frictional force applied to the balance by activating the braking element abruptly or continuously. The latter in particular enables a damped, oscillation-free stopping of the balance. A frictional braking of the balance wheel also enables the stopping of the balance in any orientation or position of the balance.

According to a further embodiment, the zero-setting device can be torque-proof coupled to the cage via the braking element. The zero-setting device can in particular influence directly or indirectly the braking element mounted on the cage. The zero-setting device, but at least individual components or parts of this can in particular lie in the power transmission path of the balance stop device.

According to a further embodiment, the zero-setting device can be fixed torque-proof to the base plate using a fixing element. By means of the fixing element, the zero-setting device can either be fixed torque-proof to the base plate or released from it so that the zero-setting device can be pivoted relative to the base plate.

It is also provided here, that the fixing element is only transferable to a released position if the cage and the zero-setting device are coupled torque-proof, a released position in which the zero-setting device together with the cage can be rotated relative to the base plate. As the fixing element can only be transferred to a release position after a torque-proof coupling of cage and zero-setting device has been made, it is possible to prevent the driving force of the mechanical energy storage device of the clockwork movement being released in an uncontrolled manner.

If the cage is coupled to the zero-setting device and the fixing element is transferred to the release position, a typical, if applicable, damped rotational movement of the cage and zero-setting device combination takes place, wherein the rotating cage has an operative connection to the energy storage device of the clockwork movement via the activated balance stop device. The seconds pinion of the tourbillon is also in this configuration, as before, in mechanical work connection with the energy storage device of the clockwork movement, with the barrel for example.

According to a further embodiment, further a locking latch is movably located on the base plate. This interacts with a catch mechanism located on the cage to stop the cage at zero position. The locking latch can for example be transferred radially inwards to a locking position in which it interacts with the catch mechanism of the cage so that a rotational movement of the cage beyond the locking latch or past the locking latch is prevented.

The catch mechanism can for example protrude radially outwards from the cage. If the locking latch is for example located in a radial inwards shifted locking position and the zero-setting device together with the cage is the subject of a rotational movement at a fixing element in the release position, the catch mechanism of the cage engages with the locking latch. The locking latch therefore acts as end stop for the catch mechanism and so for the cage so that this comes to rest in the zero position provided for the setting of the clockwork movement.

According to a further embodiment, the locking latch is coupled to the fixing element. The locking latch only moves into a locking position to stop the cage when the fixing element passes from the fixing position to the release position. The locking latch and the fixing element are rigidly coupled together in this respect. If the combination of cage and zero-setting device are released for a pivotal movement, the locking latch moves radially inwards in order to stop the free pivotal movement of the combination at a fixed predetermined position.

The mutual arrangement of catch mechanism and locking latch therefore defines the zero-position of the cage and therefore the seconds hand of the tourbillon unit located on the cage.

According to a further embodiment, the zero-setting device has a support wheel with a rim-type circumferential band. The circumferential band is rotatably mounted at its outer circumference on at least three support rollers arranged on the base plate. The zero-setting device has a ring-type basic geometry as a special feature. In a final assembly configuration of the clock movement, the hub of the tourbillon unit usually occupies the free center of the ring of the zero-setting device. By means of a mounting via the outer periphery on the support wheel, the zero-setting unit can also be rotated on the base plate independent of the tourbillon unit.

According to a further embodiment, the zero-setting device has a ring-type circulating wheel with inner teeth which mesh with a pinion of the escape wheel. The circulating wheel of the zero-setting device which is also fixed relative to the base plate in the basic configuration or when the clockwork is in motion, meshes with the escape wheel. The escape wheel moves, especially due to the teeth of its pinion with the inner teeth along those, in case the tourbillon unit is subjected to a rotary motion being predominant when the clockwork is in operation. In the basic configuration, the zero-setting device acts in this respect as an extended baseplate along whose inner teeth the escape wheel with its pinion runs.

According to a further embodiment of the clockwork movement, the zero-setting device has a stop ring which is movable along its axis of rotation. This has a start slope on a radially outer-lying edge that corresponds to the start slope of a movable stop latch located on the base plate. Two diametrically opposed escapement stopping latches are normally provided. These can be moved radially inwards in direction to the stop ring by pulling out the crown.

The stop ring experiences an axial movement due to the mutually corresponding and matching start slopes of stop ring and stop latch or stop latches, when the stop latch or stop latches are moved radially inwards. By means of the mutually corresponding start slopes of stop ring and stop latch or stop latches, a radial movement can be so translated into an axial movement.

According to a further embodiment, each movable stop ring mounted axially on the zero-setting device has a further start slope at a radial inner-lying edge that interacts with at least one cam that moves radially inwards against a restoring force at the latch mounted on the zero-setting device. In this way, that latch can be radially swiveled by an axial shift of the stop ring relative to the zero-setting device, especially relative to the at least one axially adjacently mounted latch.

In particular at least one latch of the zero-setting device can be actuated radially inwards by means of the at least one latch of the zero-setting device induced axial movement of the stop ring. Due to the mutual engaging of stop latch, stop ring and latch of the zero-setting device, it is possible that a pivoting movement acting radially from outside on the zero-setting device is converted into a radial inwards swivel movement of the latch provided at the zero-setting device.

According to a further embodiment, the at least one latch has a start slope at its inner radial end, that can be engaged with the start slope of a brake ring. The brake ring is typically arranged axially adjacent to the latch and can also be shifted axially on a main axis of the tourbillon unit relative to the zero-setting device, for example mounted on the hub of the tourbillon unit. In that the at least one latch and the brake ring engaged with it have start slopes corresponding to each other, the typically radial, inwards pointing pivot or shift movement of the latch can be translated into an axial directed displacement of the brake ring.

According to a further embodiment, it is finally intended that an axially movable brake bolt is guided in a hub of the tourbillon unit or in the cage and can be axially displaced for the displacement of the brake element and for causing the balance to stop by means of the brake ring. The brake bolt is displaceable especially against a restoring force, especially against the effect of a spring element axial to the brake ring. The brake bolt deflects especially the brake element which is movable axial to the balance wheel axis such that it engages the balance by friction or by a friction-fit and brings the balance finally to a stop.

At the zero-setting device, usually not only one latch is provided but several, about three, equidistantly spaced to each other, which due to an axial movement of the neighboring stop ring perform a synchronous, radially inwards directed movement. Correspondingly, an as uniform and symmetrical as possible displacement force can be exerted on the brake ring which finally leads to an axial advance of the brake bolt.

Finally, according to a further aspect a timepiece, especially a mechanical wrist watch, being fitted with a previously described clockwork mechanism, is provided.

BRIEF DESCRIPTION OF THE FIGURES

Further objects, features and advantageous embodiments are explained in the following description of an embodiment example with reference to the drawings. The figures show.

DETAILED DESCRIPTION

Figure 1:
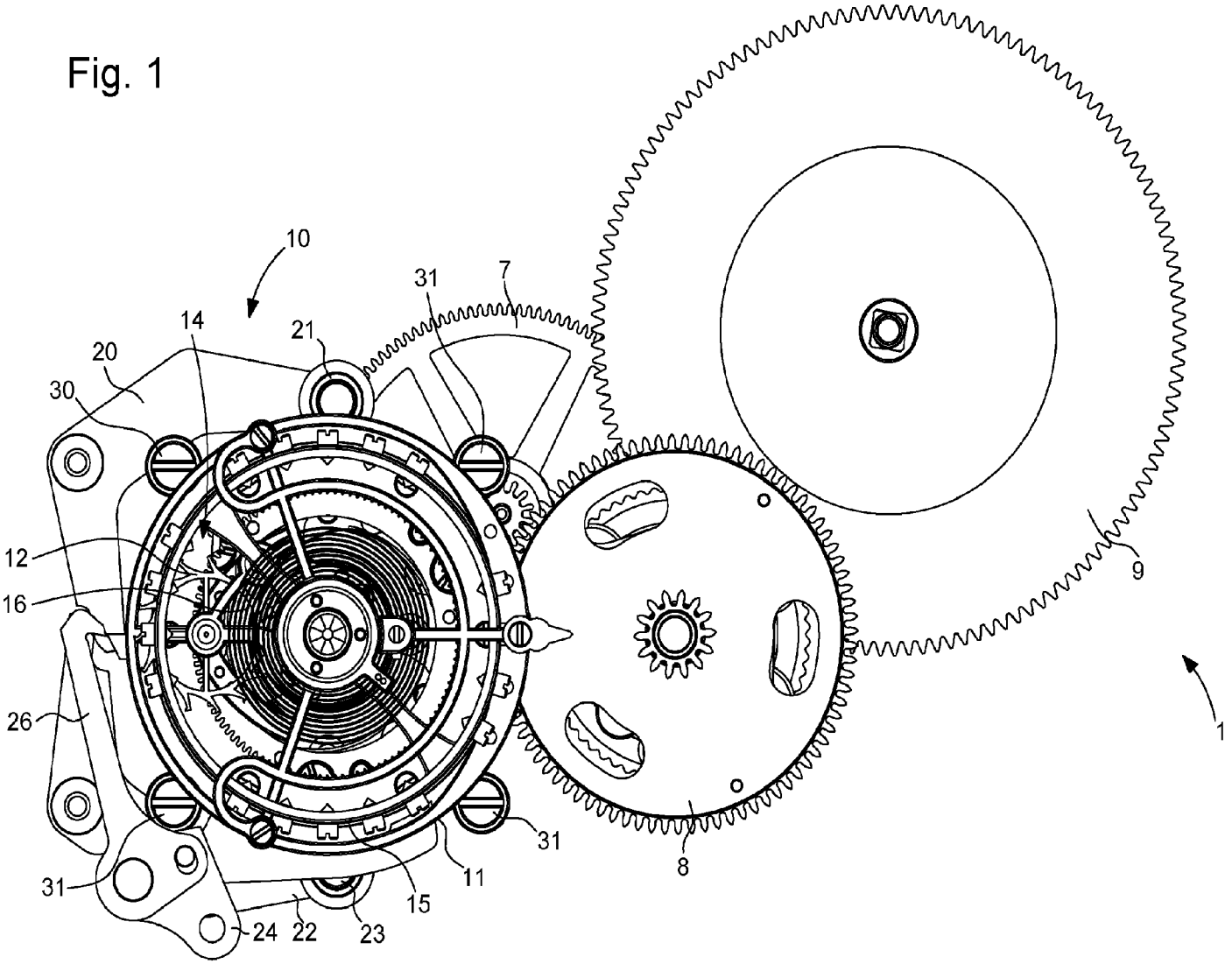
FIG. 1 a top view of parts of the clockwork movement
Figure 2:
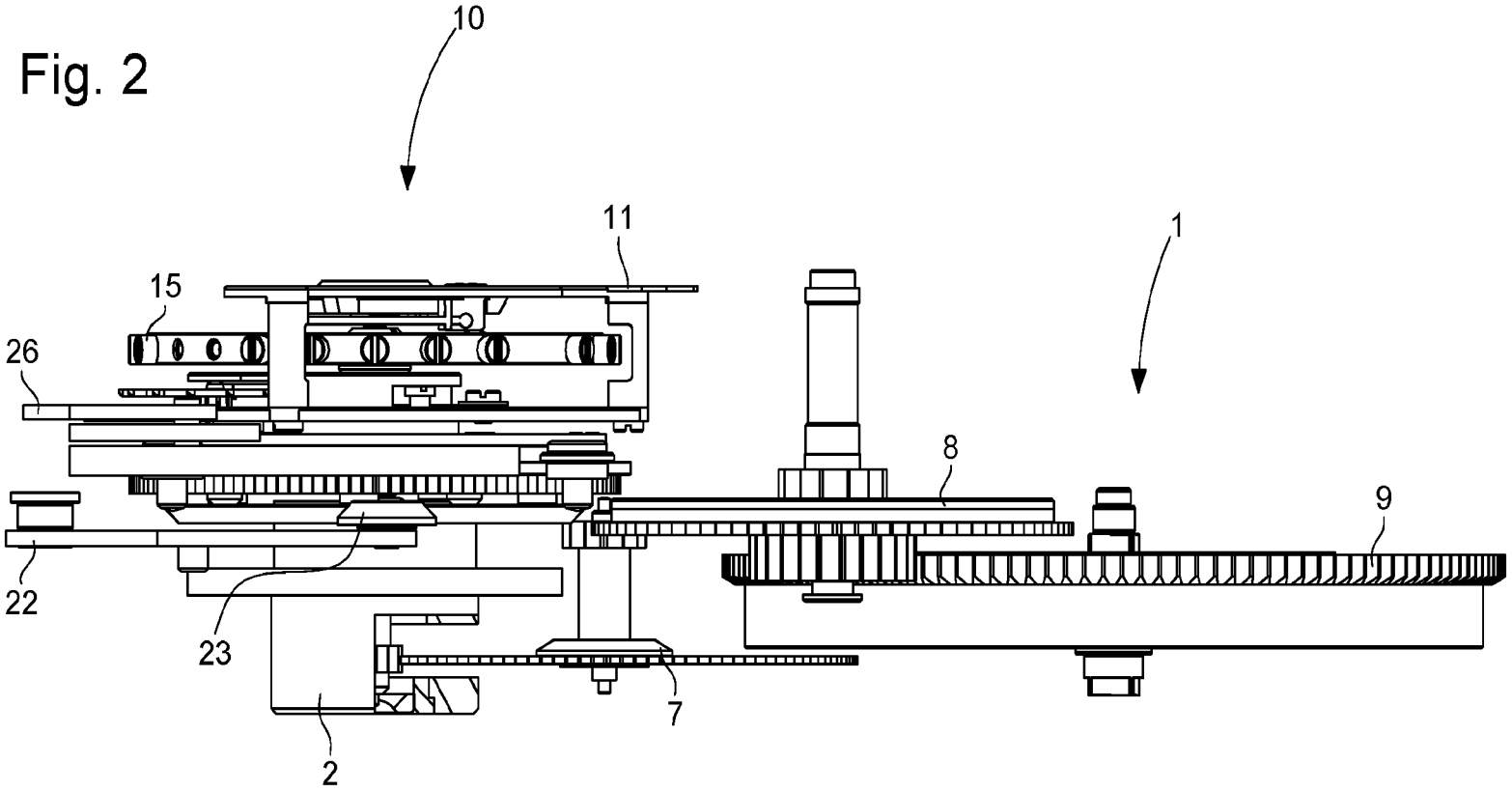
FIG. 2 a side view of the clockwork movement according to FIG. 1.
Figure 3:
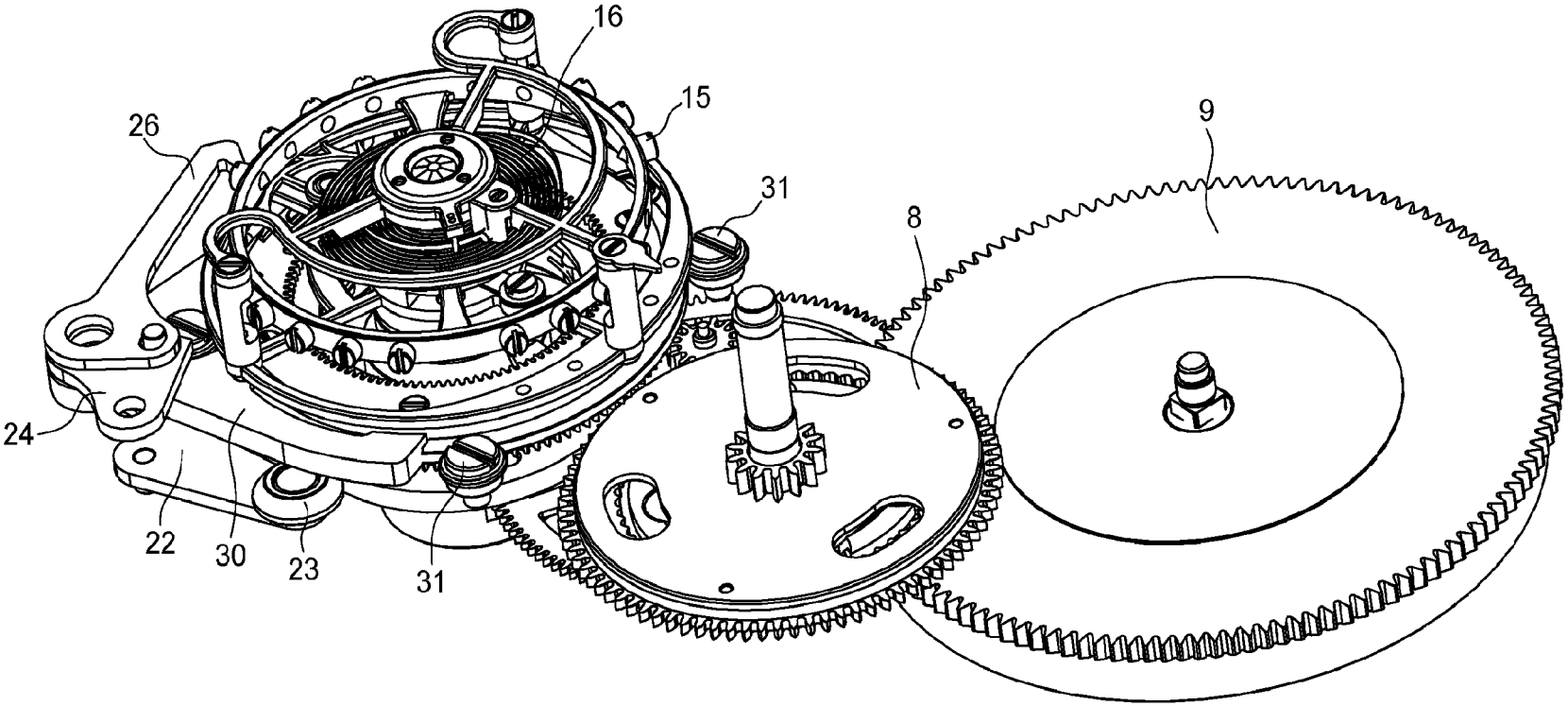
FIG. 3 a perspective view of the clockwork movement.

FIGS. 1 to 3 show a tourbillon unit 10 of a mechanical clockwork movement 1, here partially shown. The clockwork movement 1 has a base plate 2 on which the tourbillon unit 10 is rotatably placed. The tourbillon unit 10 is, as can be seen from FIGS. 2 and 11, coupled to a third wheel 7 via a seconds pinion 5. The third wheel 7 meshes with a minutes wheel 8, which engages a barrel 9, which here acts as a mechanical energy storage device.

Figure 11:
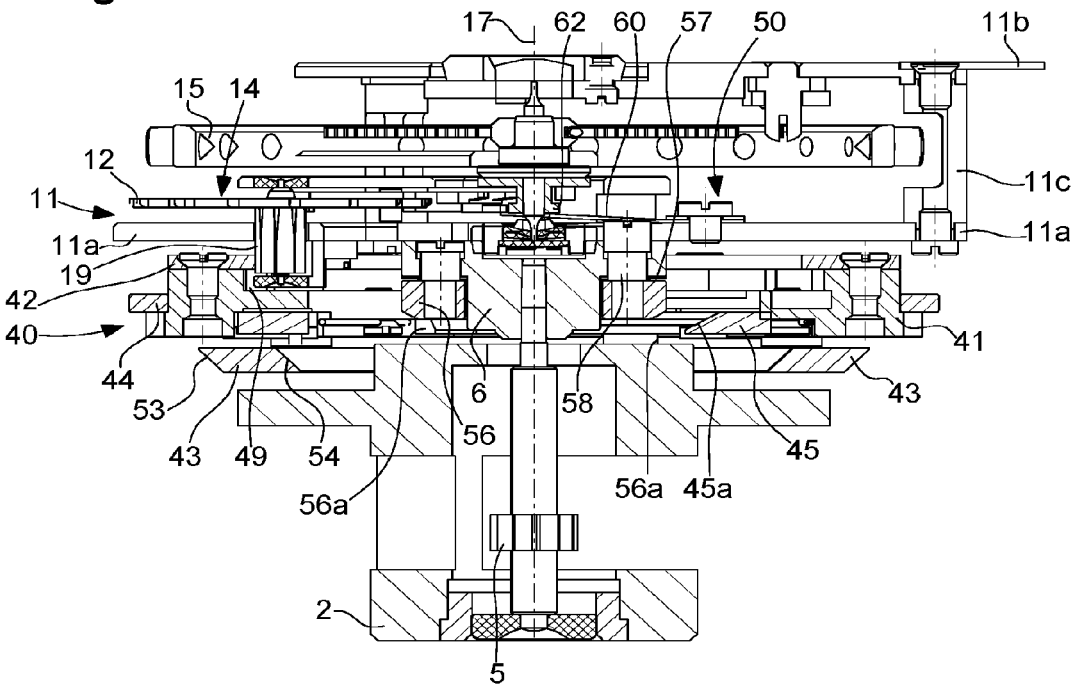

The tourbillon unit 10 further comprises a hub 6 shown in a cross-section in FIG. 11, which is rotatably placed on the base plate 2 and is fixed to a cage 11 of the tourbillon unit 10.

The cage 11 comprises a lower frame 11*a* with diverse radially arranged spokes 11*d* which join the cage 11 to the hub 6. Here, three vertical, axially directed pillars 11*c* are arranged around the outer circumference of the lower frame 11*a*. An upper frame 11*b* is placed on the end section of the far side of the lower frame 11*a*. The balance 15 of the movement 1 is placed between the upper and lower frames 11*a*, 11*b*. The balance 15 can be pivoted relative to a balance axis 17, wherein the balance axis 17 is located on an extension of the seconds pinion 5.

The balance 15 is also coupled to a balance spring 16. An escapement 14 is also provided at the cage 11. An escape wheel 12 is rotatably placed on the cage 11. The axis of rotation of the escape wheel 12 extends parallel to the balance axis 17. The escapement 14 also has a not explicitly shown pallets which engage alternately with the teeth of the escape wheel 4 in the well-known manner. The balance 16, the not explicitly shown pallets and the escape wheel 12 form the escapement 14.

As follows from the cross-section of FIGS. 11 and 12, the escape wheel 12 is fitted with a pinion 19 which meshes with the inner teeth 49 of a zero-setting device 40. The zero-setting device 40 is fixed to the base plate 2 during normal operation of the clockwork movement 1. The step-by-step rotational movement of the escape wheel 12 therefore leads to a rotation of the entire cage 11 relative to the base plate 2. Further a seconds hand 18 is located on the cage 11 with the tip of the hand protruding radially outwards from cage 11—upper frame 11*b* in the present case. The rotational position of the cage 11 therefore passes on the seconds to a time indicator.

Apart from the zero-setting device 40, the clockwork movement 1 has a balance stop device 50 which is used to stop the balance 15 if required.

Figure 4:
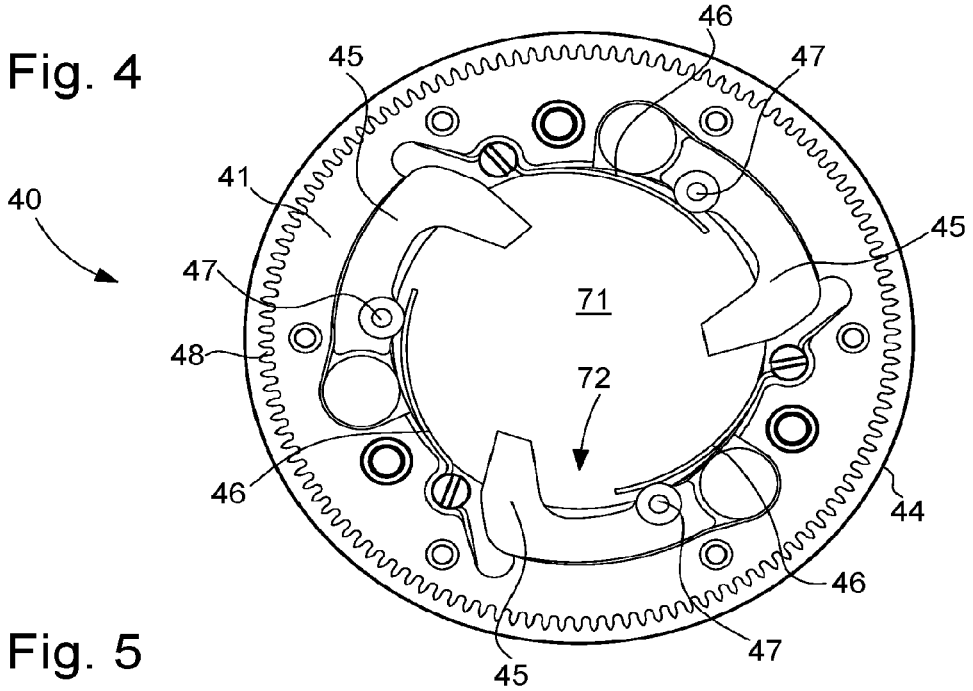
FIG. 4 a plan view from below of the zero-setting device in the base configuration with a stop ring removed, FIG. 5 a cross section of the zero-setting device according to FIG. 4, FIG. 6 a plan view of the zero-setting device from above, FIG. 7 a view of the zero-setting device according to FIG. 4, however with radially inwards displaced latches, FIG. 8 a cross section of the zero-setting device according to FIG. 7, FIG. 9 a plan view from above of the zero-setting device according to FIG. 7, FIG. 10 an exploded view of the zero-setting device, FIG. 11 a cross section A-A according to FIG. 6 in a final assembled configuration with a tourbillon unit, FIG. 12 a cross section B-B according to FIG. 9, also with tourbillon unit, FIG. 13 a perspective and partly-exploded view of the clockwork movement in the base configuration and FIG. 14 a view of the clockwork movement of FIG. 13, however with activated balance stop device and with a zero-setting device in the release position.

The multi-part structure of the zero-setting device 40 is made clear in FIGS. 4 to 10. The zero-setting device 40 has a carrier wheel 41 with a central passage 71. The carrier wheel 41 has a ring-shaped contour. The central passage 71 is bordered in particular by an inner edge 72, as indicated in FIG. 4. Three latches 45 arranged over the circumference of the inner edge 72 protrude radially inwards from the inner edge 72. These are mounted and can be rotated or pivoted in the plane of the carrier wheel 41. They can be displaced radially inwards, as a comparison of FIGS. 4 and 7 makes clear.

Each of the latches 45 has a control start slope 45*a* at its free and inwards protruding end. A dome-shaped latch cam 47 is formed on the underside of the latches 45. Each of the latches 45 is also coupled to a latch spring 46 by means of which the individual latches 45 can be displaced radially inwards against a spring force. The radially directed displacement inwards takes place via an axial force applied to the latch cams 47. If the force reduces, the individual latch springs 46 effect a movement of the latches 45 radially outwards to the start position as shown in FIG. 4.

Figure 5:
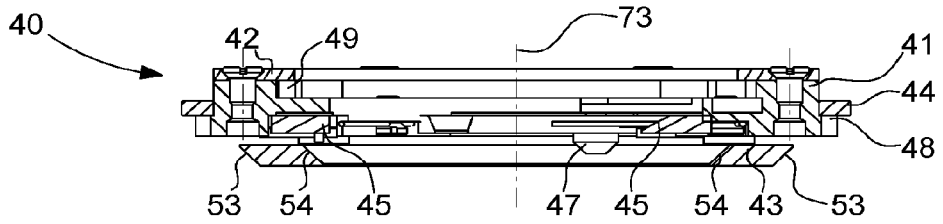
Figure 6:
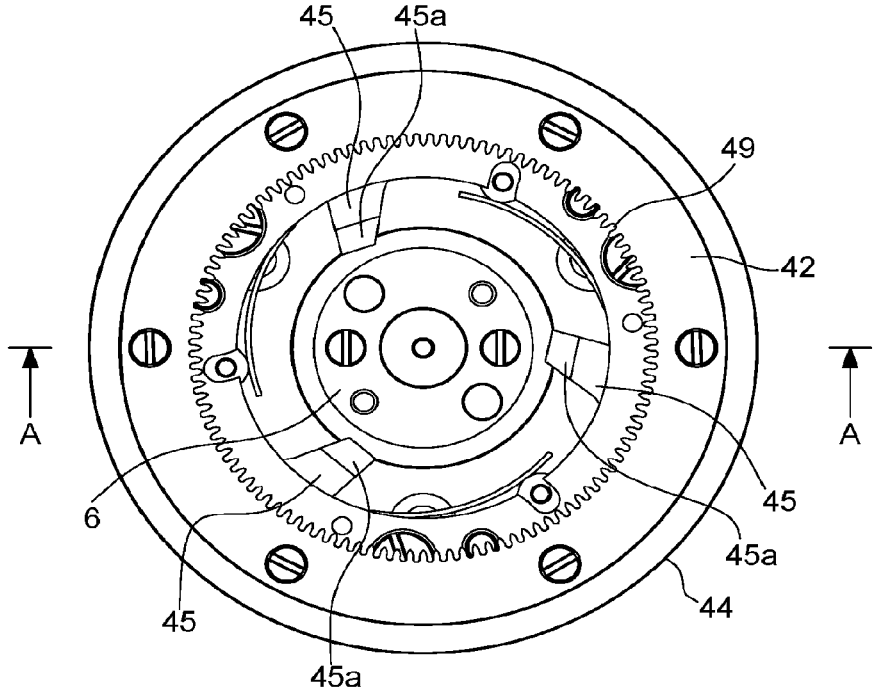
Figure 7:
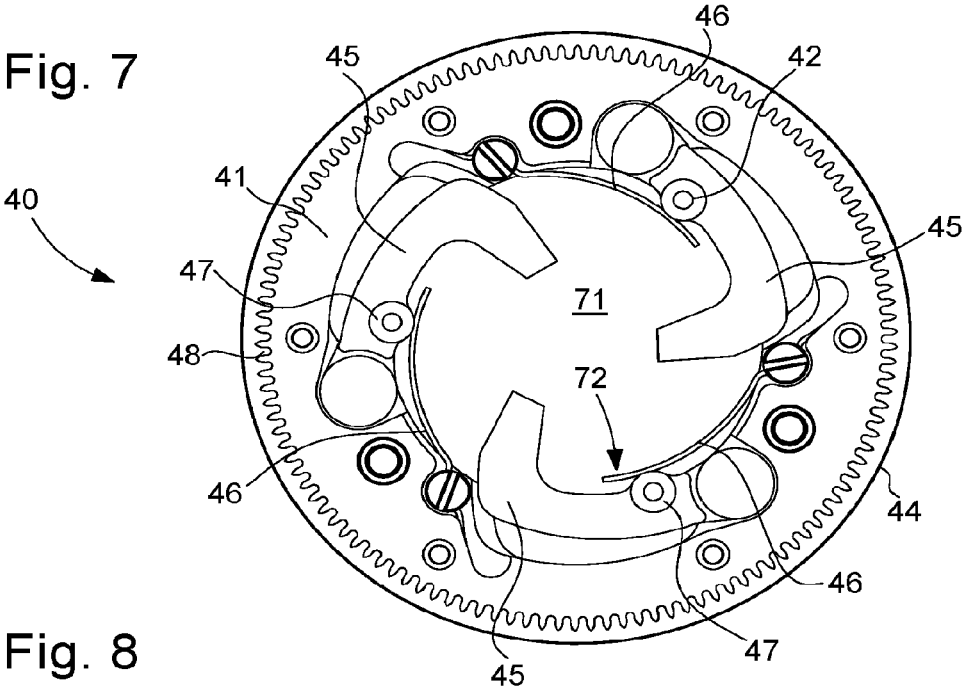
Figure 8:
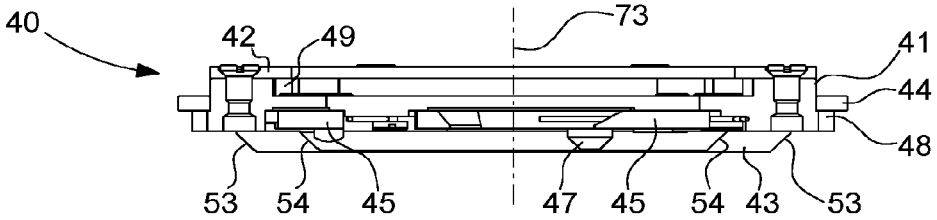
Figure 9:
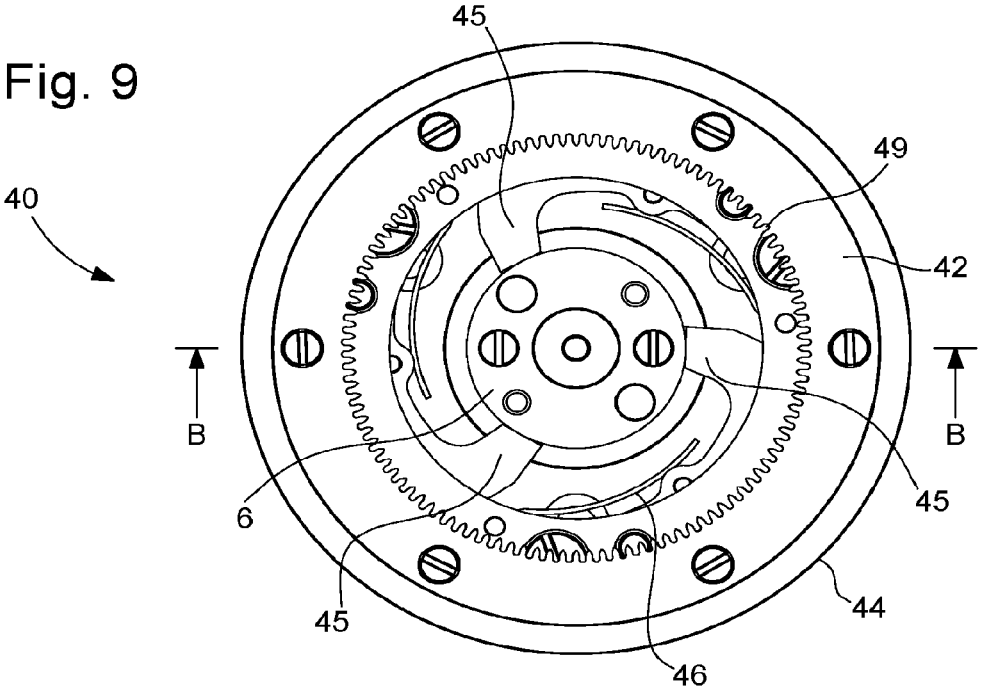
Figure 10:
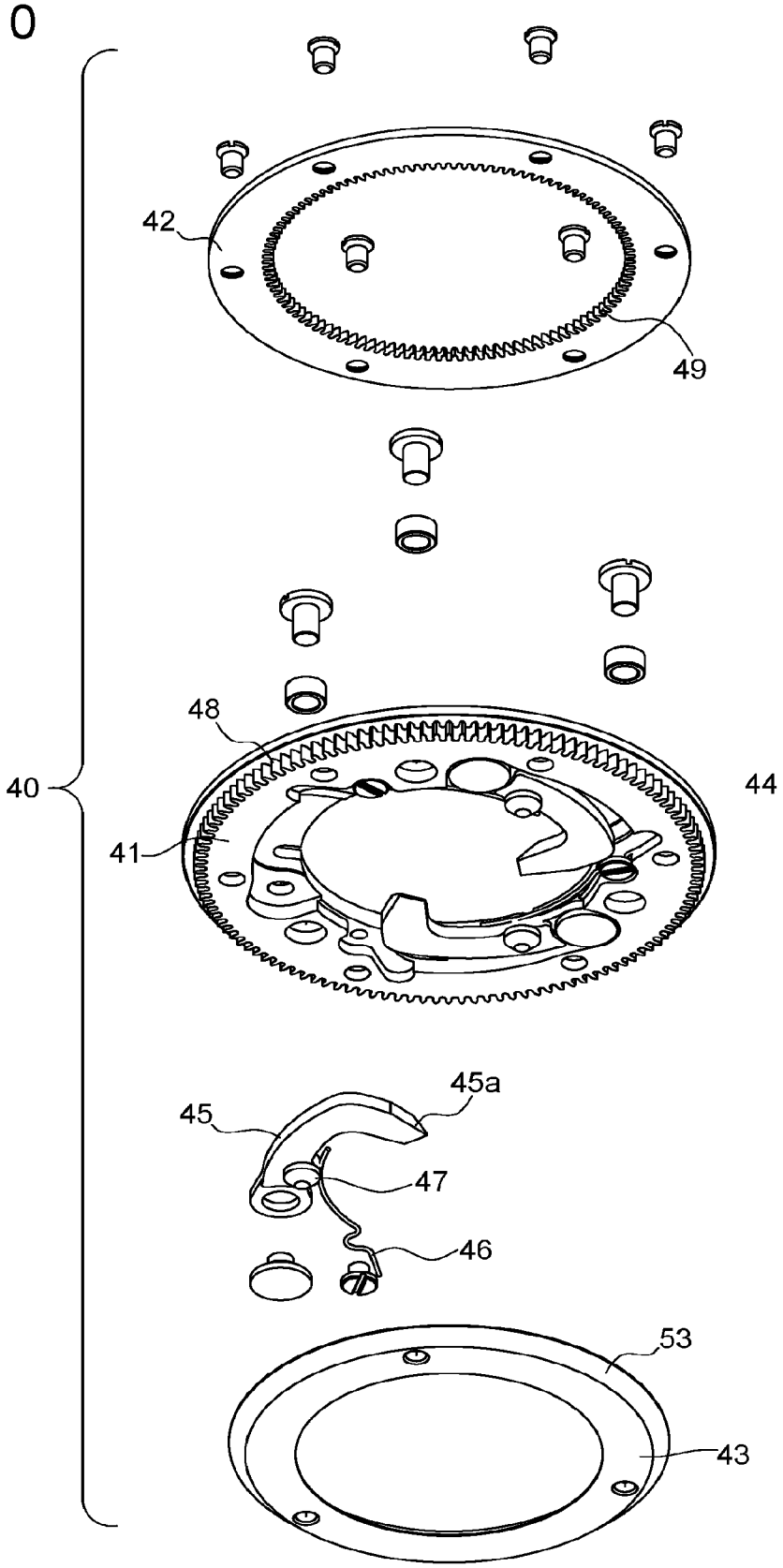

On the radially outer edge of the carrier wheel 41 of the zero-setting device 40 is, as shown in FIG. 5, formed a circular rim 44. The carrier wheel 41 has an outer toothing 48 axially offset to this. A circular wheel 42 is located on the upper side of the carrier wheel 41. The circular wheel 42 also has a ring-shaped contour. On an inner side of the circular wheel 42 circumferential inner teeth 49 are formed, which, as already mentioned, mesh with the pinion 19 of the balance 15.

A stop ring 43 is located on the underside of the carrier wheel 41. The stop ring 43 has an outer start slope 53 on its outer edge. The stop ring 43 mounted on the carrier wheel 41 can also be axially displaced. The stop ring 43 also possesses, as shown in FIG. 5, a further start slope 54 on its inner edge.

With the torque-proof connection and the axial slideability of the stop ring 43 and carrier wheel 41, the inner start slope 54 of the stop ring 43 engages the latch cam 47. An upwards axial movement of the stop ring 43 up to the carrier wheel 41 therefore effects a radial inwards displacement of the three latches 45. This can be recognized by comparing FIGS. 5 and 8 or FIGS. 6 and 9.

The entire zero-setting device 40 is rotationally mounted on the base plate 2 via the circular rim 44 with a plurality of rotatable mounting rollers 31 distributed over the circumference of the zero-setting device 40. The zero-setting device 40 can also be fixed to, but also detached from, base plate 2 using a fixing element 30 which is formed here as a fixing lever. A free end of the fixing element 30 engages, for example frictionally, with an outer edge of the zero-setting device 40.

By pivoting of the fixing element 30 the zero-setting device 40 can be released so that it can be rotated relative to base plate 2 about a central axis of rotation 73. The axis of rotation 73 of the zero-setting device 40 can coincide in particular with the balance axis 70 as well as with the axis of the seconds pinion 5.

Furthermore, a braking element 60 is mounted on the upper side of the lower frame 11*a*, here in the form of a flat brake spring. The braking element 60, especially its free and radially inwards protruding end, is located axially movable on the cage 11. In particular, it can be moved by means of an axially slidable brake bolt 58, either in the hub 6 or on the cage 11 from a starting position as shown in FIG. 11, to a braking position as shown in FIG. 12.

The brake bolt 58 is located with a head in a recess of the lower frame 11*a*. By means of an axial, upwards directed movement, the braking bolt 58 presses axially on the braking element 60 so that its free end engages frictionally and in the axial direction with a correspondingly designed friction surface of a double roller 62, which is connected to the balance 15. In this way, the balance 15 can be stopped and fixed relative to the cage 11.

Figure 12:
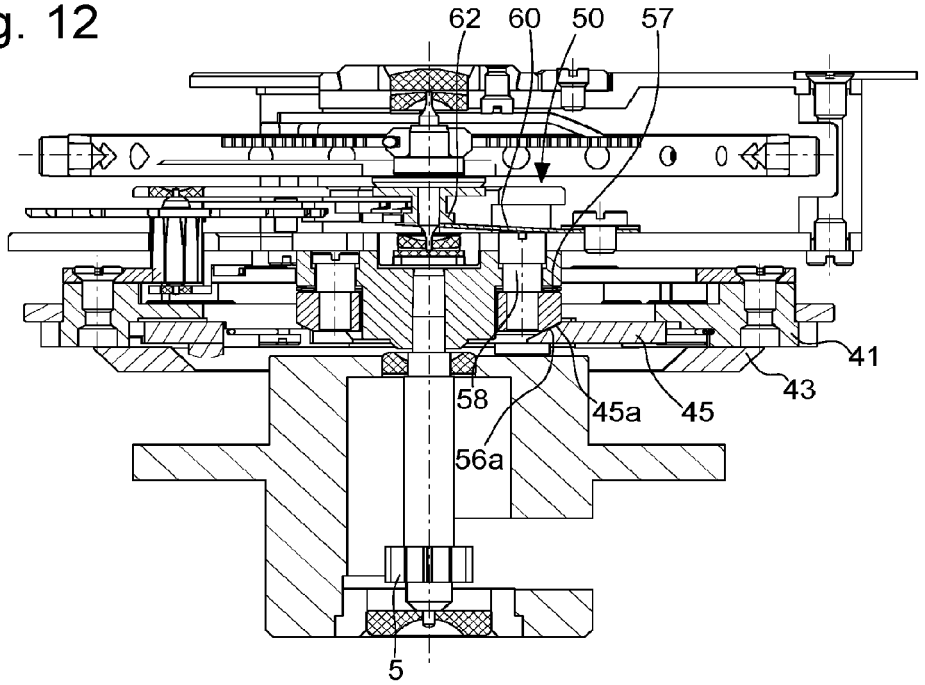

The brake bolt 58 can be transferred from the starting or base position shown in FIG. 11 to the brake position shown in FIG. 12 by means of the axially movable mounted brake ring 56. Radial external and at the lower end, the brake ring 56 has a start slope 56*a*, which is circumferentially formed and designed to correspond to the regulating start slope 45*a* of the latches 45. A radially inwards directed pivot movement of the latches 45 therefore leads to an upwards axial shift of the brake ring 56 in direction to the cage 11 by which the brake bolt 58 and therefore also the brake element 60 is axially displaced or axially shifted. Due to the radial inwards pivot movement of the latches 45, the brake element 60 finally engages with the double roller 62 of the balance 15.

The axial displacement of the brake ring 56 relative to the hub 6 or relative to the cage 11 takes place against the restoring force of a expander spring 57, which is located axially between the hub 6 and the brake ring 56. If for example, the latches 45 under the influence of their respective latch springs 46 are pivoted back into the starting position shown in FIG. 4, a movement of the brake ring 56 also takes place under the influence of the expander spring 57 in the same way to its starting position shown in FIG. 11. As a consequence, the balance 15 is again released causing the stopped clockwork movement 1 to be self-actingly set in motion again.

Figure 13:
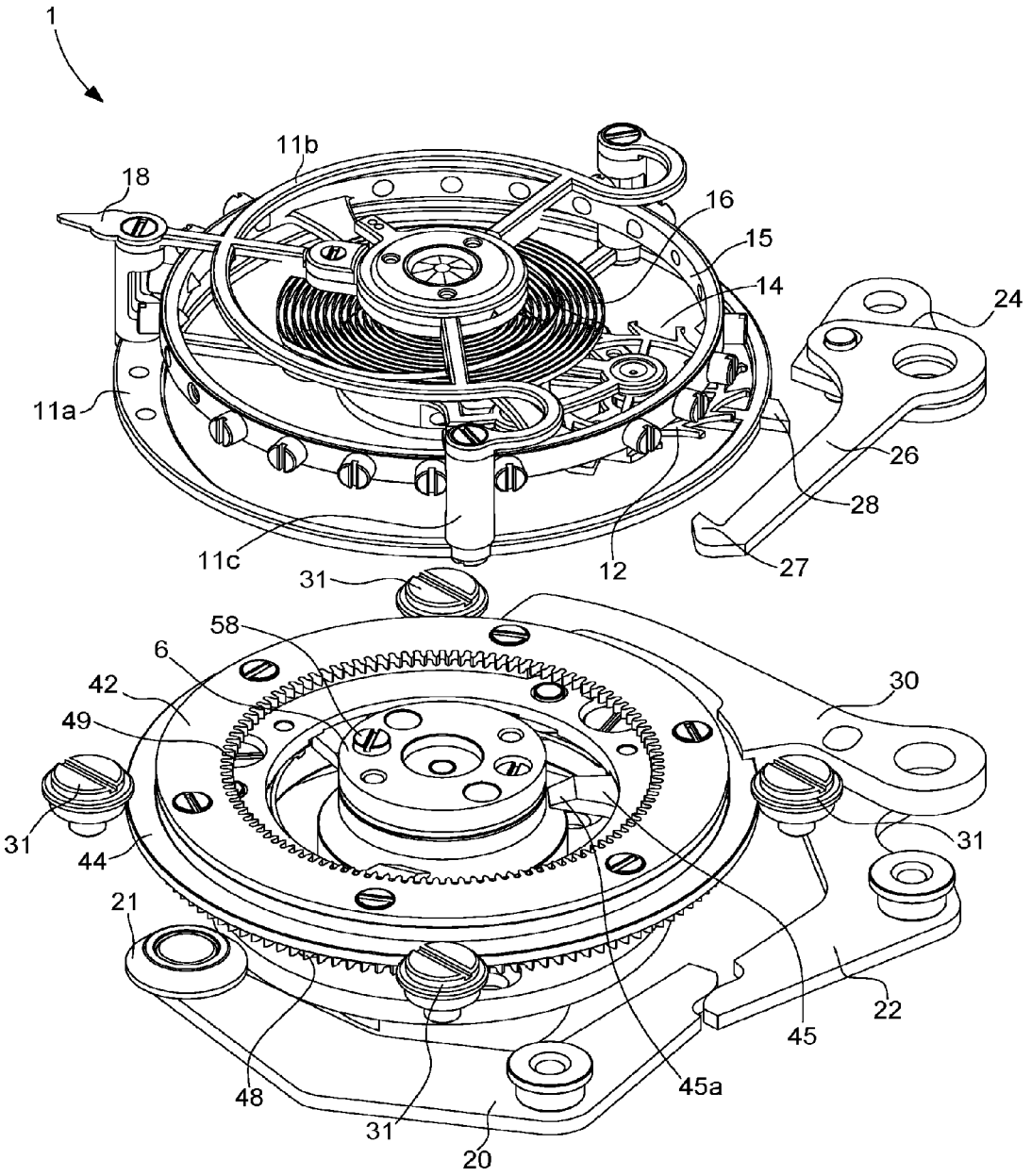

To stop the clockwork movement 1 and the tourbillon unit 10, respectively two first and second opposing stop latches 20 and 22 are provided on the outer circumference of the zero-setting device 40 as can be seen in FIG. 13. The first stop latch 20 and the second stop latch 22 are pivoting mounted on the base plate. A first start slope 21 and a second start slope 23 are provided at their free ends. These are designed, for example, in the form of beveled small wheels. Respectively the first and second start slopes 21 and 23 of the relevant first and second stop latches 20 and 22 are located at the height of the outer start slopes 53 provided on the outer edge of the stop ring 43.

A radial inwards pivoting of the first and second stop latches 20, 22 leads to a uniform raising or axial displacement of the stop ring 43 from the starting position or base configuration shown in FIG. 11 to the stop configuration shown in FIG. 12. For the sake of simplicity, the position of the first and second start slopes 21, 23 are not explicitly shown in FIGS. 11 and 12. The axial movement of the stop ring 43 leads, as already described, to a radially inwards directed displacement of the latches 45 and therefore to an axial shift of the braking bolt 58 and finally to a displacement of the braking element 60 stopping the balance 15.

A synchronous displacement movement of both first and second braking latches 20, 22 causing a stopping of the clockwork mechanism 1 can take place by pulling out the crown to a given ratchet position. This stops the clockwork movement 1. If the crown, here not explicitly shown, is pulled out starting from that stop configuration to a further, for example second ratchet position, a coupled pivoting of the fixing element 30, and of a locking latch 26 is effected.

It is initially intended here that the locking latch 26 shown in FIG. 13 is moved radially inwards so that a locking catch 27 protruding radially inwards at the free end of the locking latch engages with a catch mechanism 28 located on the outer circumference of the cage 11. In this respect, the locking latch 26 can be transferred from its start position in FIG. 13 to an indicated catch position in FIG. 14. In this, the locking latch 26 prevents the cage 11 with its catch mechanism 28 rotating beyond the position of the locking catch 27.

In the course of the zero-setting procedure, the cage 11 can be rotated freely while mounted on the base plate 2. Due to the mutual engagement of locking latch 26 and catch mechanism 28, a defined end stop for the cage 11 is therefore generated for the entire tourbillon unit 10 so that the seconds hand 18 comes typically to rest at the twelve. Once the locking latch 26 has clicked into its catch position, the fixing element 30 engaged with the zero-setting device 40 is displaced radially outwards in the course of the pulling-out movement of the crown. Thus, the zero-setting device 40 is transferred to a release position so that its rotary fixing relative to base plate 2 is nullified.

The coupled movement of locking latch 26 and fixing element 30 is initiated by control lever 24 as indicated in FIG. 13. The pivoting movements of the fixing element 30 and of the locking latch 26 are rigidly coupled together. It is necessary to ensure that the fixing lever 30 can only be transferred to its release position when the locking latch 26 is in its catch position.

When setting the timepiece, for example, the regulating lever 24 is moved by pulling a crown out of the base position to a first pull-out position, this effects a radial inwards pivoting of both first and second stop latches 20, 22. As a consequence the balance 15 is stopped. This fixes the balance 15 on the cage 11 or the hub 6. In each configuration, the cage and the zero-setting device 40 form a combination which can be rotated relative to the base plate 2.

Figure 14:
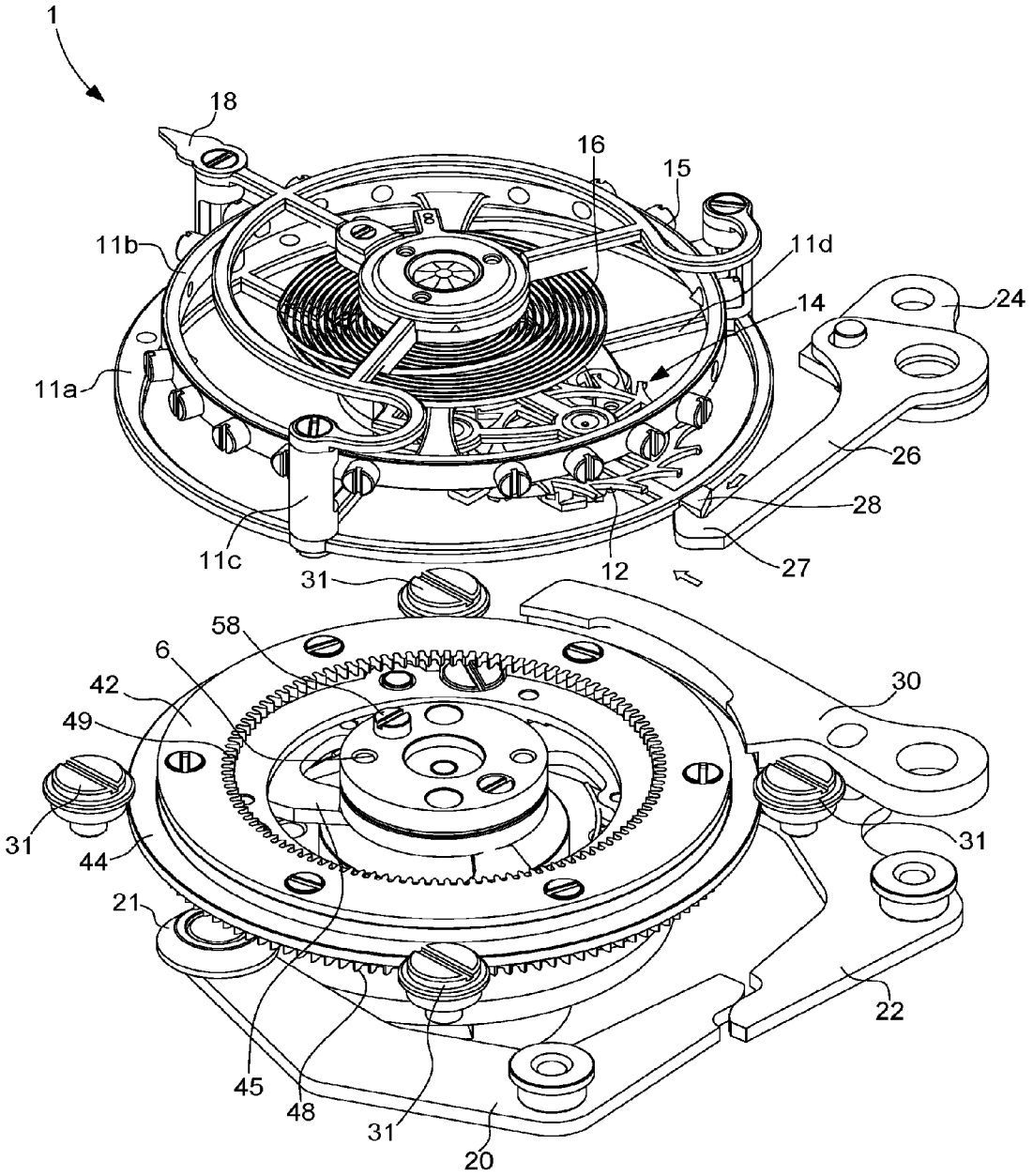

In a next step the locking latch 26 gets into the further catch position indicated in FIG. 14 when the crown is pulled out to the next catch position. Finally in a last step, the fixing element 30 is transferred to the release position so that the ensemble of zero-setting device 40 and cage 11 can be rotated via the mounting rollers 31 relative to the base plate 2. The seconds pinion 5 of the tourbillon unit 10 remains here in engagement with the barrel 9. The still remaining flow of forces between the tourbillon unit 10 and the barrel 9 effects that the cage 11 together with the zero-setting unit 40 rotates until the catch cam 28 engages with the locking latch 26.

In this axial position of the crown, the seconds hand 18 therefore automatically reaches a well-defined zero-position without any further action being necessary at the crown. The usual interaction between a zero-setting lever and a usual zero-setting flyback is therefore no longer necessary. As the zero setting of the seconds hand 18 takes place via a combined rotational movement of zero-setting device 40 and tourbillon unit 10 driven by the barrel via the seconds drive 5, this rotational movement can be preferably damped or braked using a separate braking mechanism. This braking mechanism not explicitly shown here can, for example, permanently engage with of the outer teeth 48 of the zero-setting device 40. This braking device can, for example, act as a rotational damper. It can, for example, comprise a so-called wind vane that limits the free rotational motion of the zero-setting device 40 to a preset maximum speed. According to a preferred embodiment, not shown here, the rotational damper is made as a hydraulic damper module which meshes with the outer teeth 48 of the zero-setting device 40 via an intermediate wheel. In this way, the gear ratios in this gear wheel train as well as the viscosity of the liquid in the hydraulic damper module can be set to achieve an adjusted rotational speed.

The beveled first and second start slopes 21, 23 are used, in addition to the mounting rollers 31, for the radial and axial mounting of the zero-setting device 40 on the base plate 2.

If the crown of the clockwork movement 1 is again moved back stepwise, the fixing element 30 is initially engaged frictionally with the zero-setting device 40. The locking latch 26 is then returned from its catch position back to a starting position. As a consequence, the zero-setting device 40 is on the one hand refixed to the base plate 2 while the cage 11 disengages with the locking latch 26.

To set the clockwork movement 1 automatically in motion again, it is only necessary by a further inwards movement of the crown to move the two first and second stop latches 20, 22 radially outwards again. As a consequence, the force on the stop ring decreases. This is returned in particular by the latch springs 46 and the mutual engagement between latches 45 and stop ring 43 to its starting position shown in FIG. 5. At the same time an axial displacement of the braking ring 56 to its starting position under the influence of the expansion spring 57 takes place. The brake bolt 58 therefore reaches its starting position and the braking element 60 releases the double roller 62 of the balance 15.

Due to the interaction of the zero-setting device and the balance stop device 50, it is possible for the first time to move an entire tourbillon unit 10 independently of the escapement 14 in the clockwork movement 1 in a controlled manner. That independent movement enables a tourbillon unit 10 to be moved faster and automatically to a reference point in any conceivable position. This option is especially suitable for a so-called minutes tourbillon, which serves simultaneously as a seconds hand. In this respect, a seconds zero stop is provided for a setting procedure of the clockwork movement 1.

It is especially advantageous here that no radial forces act on the tourbillon unit, neither when the balance wheel 15 is stopped nor during the zero-setting procedure. The escapement 14 is namely stopped and therefore protected against external influences during the zero setting operation. Furthermore, the here-shown embodiment of the zero-setting device 40 with the balance stop device 50 enables a small constructional change to an existing flying tourbillon, as known for example from EP 2 793 087 A1.

LIST OF REFERENCE NUMBERS

1 Clockwork movement
2 Base plate
5 Fourth pinion
6 Hub
7 Third wheel
8 Minutes wheel
9 Barrel
10 Tourbillon unit
11 Cage
11*a* Lower frame
11*b* Upper frame
11*c* Pillar
11*d* Spoke
12 Escape wheel
14 Escapement
15 Balance
16 Balance spring
17 Balance axis
18 Seconds hand
19 Pinion of the escape wheel
20 First stop latch
21 First start slope
22 Second stopping latch
23 Second start slope
24 Control lever
26 Locking latch
27 Locking catch
28 Detent cam
30 Fixing element
31 Mounting roller
40 Zero-setting device
41 Carrier wheel
42 Circular wheel
43 Stop ring
44 Circular rim
45 Latch
45*a* Start slope
46 Latch spring
47 Latch cam
48 Outer teeth
49 Inner teeth
50 Balance stop device
53 Outer start slope
54 Inner start slope
56 Brake ring
56*a* Start slope
57 Expander spring
58 Brake bolt
60 Brake element
62 Double roller
71 Passage
72 Inner edge
73 Axis of rotation

What is claimed is:

1. A clockwork movement with a tourbillon unit, comprising:

a base plate, a cage placed rotatably on the base plate, and being connected to a fourth pinion, a balance placed on the cage and an escape wheel that is placed on the cage and that is in work connection with the balance, a balance stop device being capable to be brought into engagement with the balance, wherein said clockwork movement further comprises:

a zero-setting device for the angular orientation of the cage.

2. The clockwork movement according to claim 1, wherein said zero-setting device is torque-proof engaged either with the cage or with the base plate and the zero-setting device is torque-proof fixed to the base plate in a base configuration.

3. The clockwork movement according to claim 1, wherein the zero-setting device is capable of being torque-proof coupled to the cage by means of the balance being stopped by the balance stop device.

4. The clockwork movement according to claim 1, wherein the balance stop device comprises a braking element being arranged on the rotating cage, being capable of being brought into frictional engagement with the balance and being movable axial to a balance axis.

5. The clockwork movement according to claim 4, wherein the zero-setting device is capable of being torque-proof coupled to the cage via the brake element.

6. The clockwork movement according to claim 1, wherein the zero-setting device is capable of being torque-proof fixed to the base plate by a fixing element and only by a torque-proof coupling between cage and zero-setting device the fixing element is transferable into a released position in which the zero-setting device together with the cage is rotatable mounted relative to the base plate.

7. The clockwork movement according to claim 6, wherein a locking latch is coupled to the fixing element and being transferred to a catch position for stopping the cage when the fixing element passes from the fixing position to the release position.

8. The clockwork movement according to claim 1, further comprising a locking latch movable arranged on the base plate, the said latch interacting with a catch cam being arranged on the cage for stopping the cage at a zero position.

9. The clockwork movement according to claim 1, wherein the zero-setting device has a carrier wheel with a circumference which is supported at an outer circumference by at least three rotatable rollers that are arranged on the base plate.

10. The clockwork movement according to claim 9, wherein the zero-setting device comprises a stop ring, said stop ring being axially movable relative to an axis of rotation, said stop ring having, at a radial outer edge, an outer start slope that corresponds to a respective first or second start slope of a first or second stop latch being movable arranged on the base plate.

11. The clockwork movement according to claim 10, wherein the stop ring comprises at a radial inner-lying edge at start slope that interacts with at least one cam of at least one latch that is movably mounted on the zero-setting device radially inwards against a restoring force.

12. The clockwork movement according to claim 11, wherein the at least one latch comprises at its radial inner end a control start slope being capable to be brought into engagement with a start slope of a brake ring.

13. The clockwork movement according to claim 12, further comprising a brake bolt which is axially movable guided in a hub of the tourbillon unit or in the cage and being designed axial movable by means of the brake ring for the displacement of the brake element and for stopping the balance.

14. The clockwork movement according to claim 1, wherein the zero-setting device comprises a circular wheel with inner teeth meshing with a pinion of the escape wheel.

15. A timepiece with a clockwork movement according to claim 1.

* * * * *